US005772908A

United States Patent [19]

Richard

[11] Patent Number: 5,772,908

[45] Date of Patent: Jun. 30, 1998

[54] DEVICE FOR CONTROLLING THE FLOW OF LIQUID STEEL BETWEEN A LADLE AND A CONTINUOUS CASTING DISTRIBUTOR

[75] Inventor: François Noël Richard, Nancy, France

[73] Assignee: Vesuvius France S.A., Feignies, France

[21] Appl. No.: 702,538

[22] PCT Filed: Feb. 27, 1995

[86] PCT No.: PCT/FR95/00235

§ 371 Date: Sep. 26, 1996

§ 102(e) Date: Sep. 26, 1996

[87] PCT Pub. No.: WO95/23663

PCT Pub. Date: Sep. 8, 1995

[30] Foreign Application Priority Data

Mar. 4, 1994 [FR] France ..... 94 02622

[51] Int. Cl.[6] ..... B22D 41/50

[52] U.S. Cl. ..... 222/594; 222/606; 222/607

[58] Field of Search ..... 266/236; 222/594, 222/590, 600, 606, 607

[56] References Cited

U.S. PATENT DOCUMENTS 4,290,589 9/1981 Luhrsen et al. ..... 222/594
5,358,551 10/1994 Saylor ..... 222/594
5,494,201 2/1996 Szadkowski ..... 222/606

FOREIGN PATENT DOCUMENTS 2 521 462 8/1983 France .
39 02 545 8/1990 Germany .
363295056 12/1988 Japan ..... 222/600

*Primary Examiner*—Scott Kastler
*Attorney, Agent, or Firm*—Oblon, Spivak, McClelland, Maier & Neustadt, P.C.

[57] ABSTRACT

A device for controlling a flow of liquid steel from a ladle (1) to a continuous casting distributor (8). The device includes a frame connected to the ladle (1) and comprising a guide assembly; a plate (3) movable on the guide assembly for sealing the casting opening (2); an assembly for compressing said plate (3); and a jet nozzle tube (4) extending from the casting opening (2). The plate for sealing the casting opening (2) is a sealing plate (3) designed only to seal the casting opening (2); the jet nozzle tube (4) and a plate (34) together form a rigid assembly moving along the guide assembly to a position opposite the casting opening where it replaces the sealing plate (3) which is thus driven from this position; and a compression assembly holds the plate (34) of the plate/jet nozzle tube assembly (4, 34) in sealing contact with a fixed upper plate (30).

22 Claims, 7 Drawing Sheets

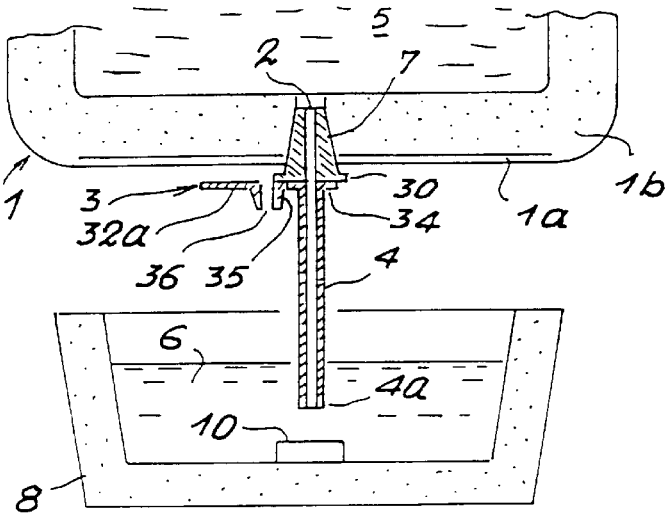
FIG. 1
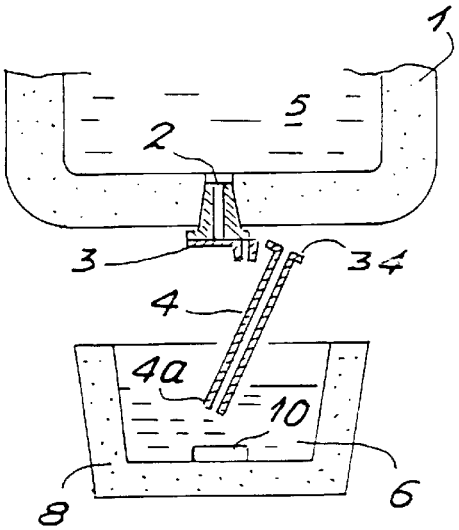
FIG. 2
FIG. 3
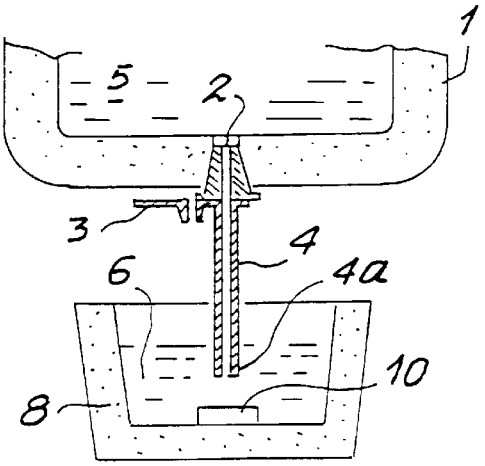
FIG. 4
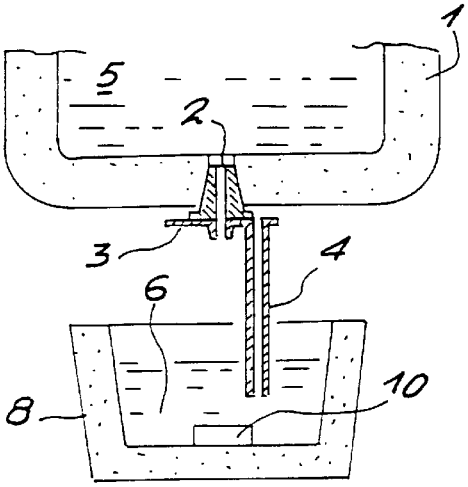

DEVICE FOR CONTROLLING THE FLOW OF LIQUID STEEL BETWEEN A LADLE AND A CONTINUOUS CASTING DISTRIBUTOR

The present invention relates to a device for controlling the flow of liquid steel between a ladle and a continuous casting distributor which can contain a liquid steel bath, said ladle being able to contain and transport a liquid steel quantity between a remote site and a continuous casting platform, said ladle having a casting hole making it possible to transfer the liquid steel into the distributor, said casting hole being surrounded by an upper, fixed plate, the device comprising a frame connected to the ladle and having guidance means, a plate displaceable on the guidance means and able to seal the casting hole, said device also including means for pressurizing said plate, means for protecting the liquid steel jet during its passage from the ladle to the distributor, said means in particular incorporating a jet protection tube to be placed in the extension of the casting hole and which has a lower end to be immersed in the liquid steel bath contained in the distributor.

It also relates to a process for controlling the flow of liquid steel between a pocket and a continuous casting distributor able to contain a liquid steel bath, said ladle being able to contain and transport a liquid steel quantity between a remote site and a continuous casting platform, said ladle having a casting hole permitting the transfer of the liquid steel into the distributor, said casting hole being surrounded by an upper, fixed plate.

According to the prior art, the ladle generally has a blanking cover or obturator equipped with a slide valve able to receive in general two refractory plates, each having an orifice, one of the said plates (the upper plate) being fixed. It is connected to an internal nozzle placed in the ladle casting hole. The other plate (the lower plate) is mobile with respect to the fixed plate. When the orifice of the fixed plate and that of the mobile plate are displaced, the casting hole is completely closed. When the orifices of the refractory plates overlap to a greater or lesser extent, the steel flow is constricted, which makes it possible to regulate its discharge. An example of such a device is described in European patent EP 202 213.

At the start of a casting sequence the ladle is empty. It is equipped with a slide valve, which is closed. The ladle is then filled with steel and, after various treatment operations, it is transported on the continuous casting platform. A current practice consists of placing the full ladle on a wheel, which performs a rotation by a half-turn to bring the ladle above the distributor.

Moreover, existing requirements concerning steel quality make it ever more frequently necessary to protect the steel jet against any contact with the air between the ladle and the distributor in order to prevent its oxidation. One currently used method consists of extending the ladle casting hole by a jet protection tube made from a refractory material. The end of this tube is immersed in the steel bath contained in the distributor, so as to ensure a tight channel between the ladle and the distributor. This jet protection tube is generally mounted on a nozzle, known as the collecting nozzle, which is integral with the mobile plate of the slide valve-equipped blanking cover of the ladle.

The jet protection tube must generally be placed on the casting location, i.e. when the ladle is placed above the continuous casting distributor. It is rarely possible to equip the ladle with the jet protection tube prior to its being brought to the casting location, because existing plants and workshops generally do not have an adequate space beneath the ladle for housing such a tube on the equipments where the ladle is to stay or be transported prior to casting, e.g. the furnace, ladle treatment and transfer trolleys.

Thus, there are three functions which must be ensured for the transfer of the liquid steel from the ladle to the distributor:

- the complete sealing of the casting hole during transport of the ladle and also, for safety reasons, in the case of an incident or accident occurring during casting operations,
- the regulation of the liquid steel flow so that the liquid steel level within the distributor can be kept at the desired height,
- the protection of the liquid steel jet against oxidation by air.

At present, the first two functions are fulfilled by the ladle slide valve and the third by the jet protection tube.

When the ladle is empty, the slide valve is closed and then the jet protection tube is removed. The slide valve drive means (jacks) are disconnected. The ladle is brought into a plant or workshop, where checks are made to the wear of the slide valve refractories, which are replaced if wear thereto has been noted.

A continuous casting installation of the type described hereinbefore suffers from a certain number of disadvantages.

The seal between the collecting nozzle of the ladle slide valve and the jet protection tube is installed in situ on the casting platform under unfavourable conditions, so that it does not ensure a good seal. The said seal does not have any mechanical strength. Therefore means must be provided for keeping the jet protection tube engaged against the collecting nozzle. This is generally brought about by a manipulator, which has a collar supporting the head of the jet protection tube and which applies it to the collecting nozzle. However, as the collecting nozzle is mobile at the same time as the plate to which it is fixed, the inertia of the manipulator is added to that of the tube and the hydrodynamic resistance of the liquid steel in which is immersed the lower end of the jet protection tube creates mechanical stresses on the junction between the collecting nozzle and the jet protection tube. These stresses aggravate the sealing and mechanical strength problems over a period of time with respect to said seal.

The refractory plates of the slide valve become worn relatively rapidly because they permanently rub against one another throughout the casting time in the presence of steel. It is consequently necessary to replace them at regular intervals. The time necessary for this replacement varies as a function of the difficulty of the operations to be performed. This consequently leads to irregularities in the ladle rotation cycle, which disturb the organization of the continuous casting sequences. For example, if it is found that the changing of the refractory plates of the slide valve takes up too much time, the decision might be taken to use a reserve ladle. The operation of the installation makes it necessary to have reserve ladles.

The present invention relates to a device for controlling the flow of liquid steel for a ladle obviating the aforementioned disadvantages.

These objectives are achieved by the fact that the plate able to seal the casting hole is a cover plate intended solely for the sealing of the casting hole, the jet protection tube is formed in a solid and rigid assembly with a plate, which can be received and moves on guidance means in order to face the casting hole replacing the cover plate which is pushed away, pressurizing means being provided to maintain the plate of the plate/jet protection tube assembly applied in sealed manner against the upper, fixed plate.

As a result of these characteristics the plate and jet protection tube are constructed in a solid assembly, which can also be in one piece. It can also be constituted by an assembly of several parts so as to form a rigid entity. Thus, there is no connection between a tube and a collecting nozzle. There is also no need to support the jet protection tube by means of a manipulator, because the latter forms with the plate a one-piece assembly retained in guidance means connected to the ladle.

The putting into place of the plate/jet protection tube assembly consequently takes place in a single operation.

The checking of the refractories is simplified, because the lower plate is dismantled and visible following each casting operation.

Preferably, the device also comprises a manipulator independent of the ladle and located in a position associated with the continuous casting platform, said manipulator having at least two actuating means, e.g. jacks, a first actuating means making it possible to bring and/or remove the plate/tube assembly to or from the entrance of the guidance means and a second actuating means making it possible to introduce the cover plate and/or the plate of the plate/jet protection tube assembly into the guidance means of the frame and push the plate of the plate/tube assembly in front of the casting hole, so that it pushes the cover plate or vice versa.

Preferably, the second actuating means is constituted by a fork formed by two fingers, a first finger for pushing the plate/tube assembly and the cover plate and a second finger for exerting a reciprocal action to bring the cover plate and the plate/tube assembly in front of the fixed plate. Preferably, said finger is able to support the plate/tube assembly.

In a preferred embodiment the manipulator has a guide and the frame a counterguide in which the manipulator guide engages in order to adjust the position of the manipulator with respect to the frame. The guide and counterguide also make it possible to bring within the device the forces exerted by the actuating means and the reaction forces caused by them, said forces cancelling one another out.

In order to facilitate their handling, the cover plate and/or the plate/jet protection tube assembly can be placed in a support, which comprises said pressurizing means.

Preferably, the means for regulating the liquid steel flow of the continuous casting ladle to the distributor are constituted by means for bringing about a constriction of the passage section offered to the liquid steel at the lower end of the jet protection tube to be immersed in the liquid steel bath contained in the distributor.

According to the prior art devices the constriction of the liquid steel flow, i.e. the area of the runner where the passage section is reduced in order to regulate the flow rate, is located upstream of the jet protection tube. Consequently, under the effect of a physical phenomenon known as venturi, the interior of the jet protection tube is under reduced pressure compared with the atmosphere. This leads in the case of the slightest sealing defect of the runner downstream of the constriction to an air suction, which leads to a deterioration of the steel quality.

As a result of the present feature of the invention the runner is under an overpressure with respect to the atmosphere and the venturi phenomenon is eliminated. Thus, in radical manner elimination takes place of the aforementioned air suction phenomena, even in the case where the runner is not airtight. Consequently, there is a significant improvement to the steel quality. In addition, the plate of the plate/tube assembly is fixed and not subject to wear.

The checking of the refractories can be reduced to a simple lancing operation, i.e. the cleaning of the casting hole by means of an oxygen lance. This operation can be automated, which eliminates a difficult task of checking the refractories. As a result of this simplification concerning the checking of refractories, the cycle time is reduced and in particular made more regular, which simplifies the continuous casting organization.

According to an embodiment, the means for bringing about a constriction of the passage section offered to the liquid steel comprise a firebrick integral with the distributor and which faces an orifice of the jet protection tube, the regulation of the liquid steel flow being obtained by varying the position of the ladle with respect to that of the distributor and/or by varying the position of the distributor with respect to that of the ladle.

According to an embodiment, the jet protection tube is extended by a sleeve coaxial to the tube and sliding under hard friction on the tube so as to ensure security if the distance between the continuous casting ladle and the distributor was accidentally reduced.

According to an embodiment, the means for bringing about a constriction of the passage section offered to the liquid steel are constituted at least by one firebrick movable facing at least one outlet for the liquid steel located on the lower part of the jet protection tube.

According to an embodiment, several orifices are made in the lower part of the jet protection tube, said orifices being regularly mutually spaced and the means for bringing about a constriction of the passage section offered to the liquid steel are actuated symmetrically in order not to create a lateral reaction force on the tube end.

According to an embodiment, the jet protection tube has at least one lateral orifice in its lower part and the regulation of the liquid steel outflow is obtained by a sleeve coaxial to the jet protection tube, which is mobile in translation along said tube and/or mobile in rotation about said tube.

According to an embodiment, the sleeve has at least one orifice making it possible to regulate liquid steel outflow, the lower edge of said orifice being higher than the lower edge of the sleeve.

According to an embodiment, the cover plate has a solid area known as the covering area and an access orifice outside said covering area, the access orifice being optionally provided with a collecting nozzle, so as to give access to the casting hole of the continuous casting ladle without it being necessary to remove the jet protection tube.

According to an embodiment, the access orifice of the cover plate is positioned between the plate of the plate/jet protection tube assembly and the covering area of the cover plate when the latter and the other plate are engaged in the guidance means, said position of the access orifice being intended to reduce the distance necessary for passing from the position in which the access orifice faces the casting hole to the position in which the jet protection tube faces said casting hole.

According to an embodiment, said first finger is able to support the plate/tube assembly.

The process for controlling the flow of liquid steel between a ladle and a continuous casting distributor is characterized in that a cover plate able to seal the casting hole is introduced into the guidance means linked with the ladle, said cover plate is brought into a facing position with respect to the fixed, upper plate, whilst applying it tightly against said fixed, upper plate, the casting ladle is filled with liquid steel, the ladle is brought onto the continuous casting platform, a plate/jet protection tube assembly independent of the ladle is introduced into the guidance means on the continuous casting platform and the plate/jet protection tube assembly is pushed away, which expels the cover plate, whilst tightly applying it to the fixed, upper plate.

Following the stages defined hereinbefore, e.g. when the ladle is empty or in the case of an instant, the cover plate is again placed in front of the fixed, upper plate, whilst sealingly applying it to said fixed, upper plate, which seals the casting hole and simultaneously frees the plate/jet protection tube assembly.

According to the invention, the plate/jet protection tube assembly is placed in the guidance means of the frame by means of a manipulator independent of the ladle and located in a position associated with the casting site, the cover plate and/or the plate/jet protection tube assembly being displaced by actuating means associated with said manipulator.

According to the invention, the outflow of liquid steel is regulated independently of the closing function of the casting hole by means of the cover plate linked with the ladle.

The outflow of liquid steel is regulated by sealing to a greater or lesser extent an orifice located at the end of the jet protection tube immersed in the liquid steel bath contained in the distributor.

Sealing takes place to a greater or lesser extent of the orifice at the end of the jet protection tube by varying the position of the ladle with respect to that of the distributor and/or by varying the position of the distributor with respect to the ladle position.

Other features and advantages of the invention can be gathered from the following descriptive relative to non-limitative embodiments and the attached drawings, wherein show:

BRIEF DESCRIPTION OF THE DRAWINGS

FIG. 1 A simplified overall view of the liquid steel flow control device according to the invention.

FIGS. 2, 3 and 4 The different stages of the liquid steel flow control process according to the invention.

FIG. 1 is an overall view of the device for controlling the flow of liquid steel between a ladle 1 and a distributor 8. The ladle 1 has a metal envelope 1*a* covered with a refractory coating 1*b*. It is able to contain a quantity of liquid steel 5. An internal nozzle 7 traverses the refractory coating 1*b*. The nozzle 7 defines a casting hole 2 permitting the passage of the liquid steel. The casting hole is surrounded by a fixed, refractory plate 30, whose lower face defines a planar sliding surface. The internal nozzle 7 and fixed plate 30 can be in one piece, i.e. moulded in a single operation. They can also be produced separately and then assembled in a same metal sheet.

Figure 5:
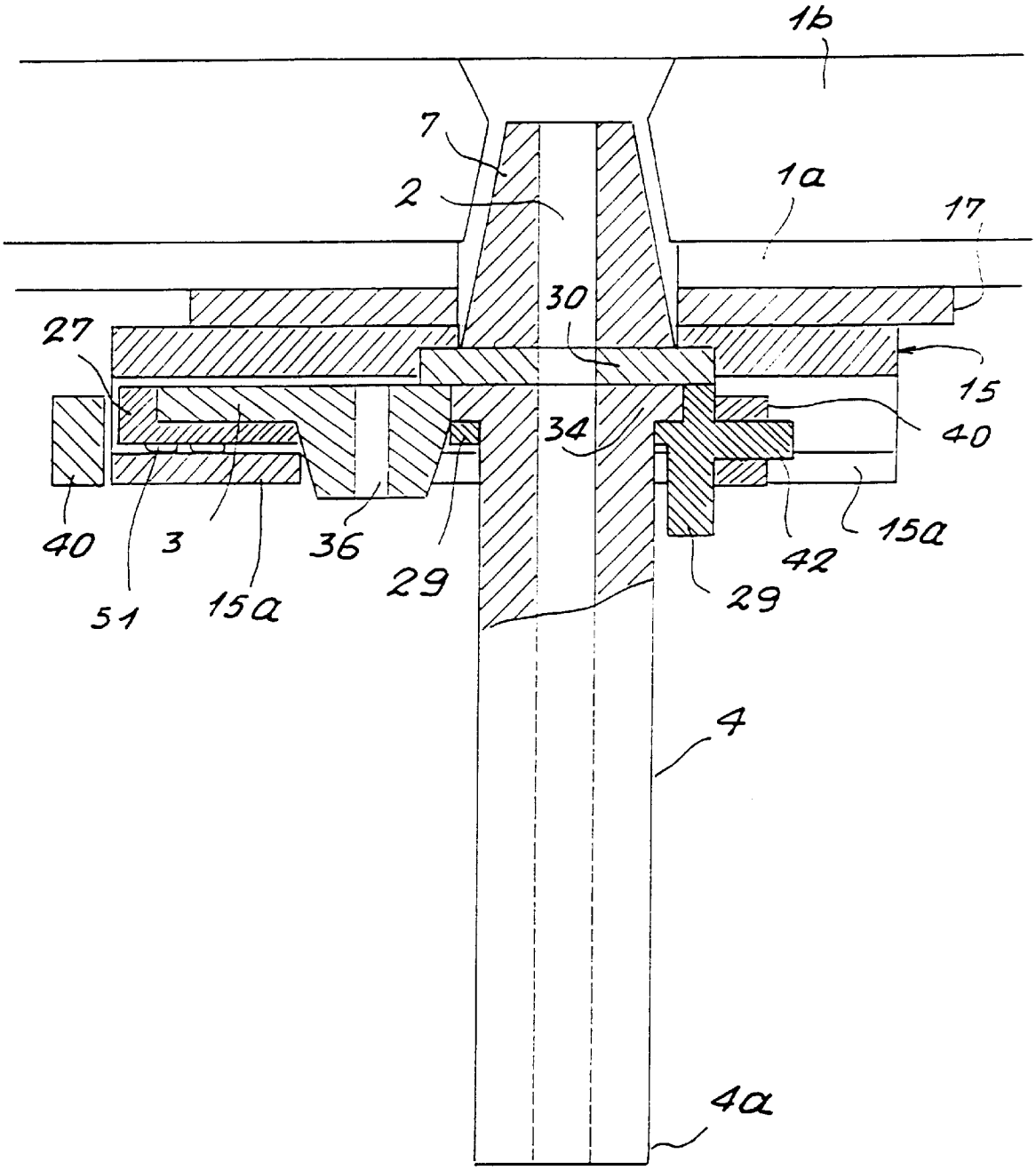
FIG. 5 A more detailed sectional view on a larger scale of the steel flow control device of FIGS. 1 to 4.

According to the invention, the steel flow control device incorporates a plate/jet protection tube assembly 4, 34 for protecting the liquid steel against the atmospheric oxygen during its transfer from the ladle 1 to the distributor 8. The jet protection tube 4 is located in the extension of the casting hole 2. It has a lower end 4*a* for immersing in a liquid steel bath 6 contained in the distributor 8.

The plate 34 can slide on the fixed plate 30 and is introduced into guidance means, which are not shown in FIG. 1, but which will be described subsequently. It can also be applied to the fixed plate 30 so as to bring about a tight connection between these two plates by pressurizing means, which are not shown in FIG. 1, but which will be described subsequently.

The jet protection tube 4 and the plate 34 can be produced in a monoblock assembly (moulded in a single operation) or can be constituted by two assembled parts. However, in both cases, they constitute a rigid and non-deformable assembly. The connection between the tube 4 and the plate 34 is able to transmit a high mechanical force. It is for this reason that, according to the invention, there is no need to support the jet protection tube by a manipulator. Thus, the connection between the tube and the plate has an adequate mechanical strength to ensure that the forces imparted to the plate 34 are transmitted directly to the jet protection tube 4.

FIG. 1 also shows the cover plate 3, which has a solid area known as the covering area 32*a*. The covering area 32, when positioned facing the casting hole 2, makes it possible to tightly seal the ladle 1. The cover plate 3 is used when the ladle transports steel from one site to another.

The cover plate 3 also has an access hole 36 extended by a nozzle in the embodiment shown in FIG. 1. The function of this access hole 36 will be described relative to FIGS. 2 to 4.

It is pointed out that the cover plate 3 does not form part of the means for protecting the liquid steel jet against the air. This represents a difference compared with the known devices using a slide valve with two or more rarely three plates. Thus, in such devices, the plates of the slide valve are located on the path of the steel and it is said that they "see" the steel. These plates rub against one another during casting regulation and are consequently subject to wear. However, in the present invention, the cover plate 3 is positioned facing the casting hole 2 at the moment of closing the ladle and is then moved away from this position when the plate/jet protection tube assembly is put into place. It is consequently not exposed to permanent wear.

FIGS. 2 to 4 show the successive stages of the process for controlling the flow of liquid steel in the present invention for a device like that shown in FIG. 1. The ladle is firstly closed by the introduction of the cover plate 3 into the guidance means linked with the ladle on a site remote from the continuous casting platform, e.g. an electric furnace or converter. The ladle is filled with steel and then transported to the continuous casting platform. It is placed above a distributor 8, as shown in FIG. 2. The plate/jet protection tube assembly 4, 34 is positioned horizontally due to the inadequate space existing between the ladle and the distributor. The tube is then progressively straightened to bring the plate 34 into the guidance means linked with the ladle 1, whilst the lower end 4*a* of the tube 4 is immersed in the liquid metal bath 6 of the distributor 8. The plate 34 is then placed facing the casting hole 2, which expels the cover plate 3 (position shown in FIG. 3).

If the opening operation has taken place correctly, casting continues from the position shown in FIG. 3. However, if as sometimes arises, the steel has set or solidified in the casting hole 2, it is necessary to return to the position shown in FIG. 4. In this position the access hole 36 permits the introduction of an oxygen lance into the casting hole 2 in order to unblock it. When the liquid steel starts to flow, the lance is withdrawn and the plate 34 is again pushed into the position shown in FIG. 3 without moving aside the jet protection tube. Preferably, the access hole 36 is positioned on the side of the plate 3 in contact with the plate 34. In other words, the access hole is located between the solid covering area 32*a* of the plate 3 and the plate 34. In this way the path between the access hole 36 and the tube 4 is as short as possible. This arrangement avoids liquid metal solidifying in the casting hole at the time of opening. The time required for passing from one position to the other is very short, representing approximately 1 to 2 seconds. It is known that the obstruction of the casting hole mainly occurs at the start of casting when the runner is still cold. The known devices require about 10 seconds from the time of unblocking the orifice to the putting into place of the casting tube. This excessive time leads to the setting of the metal in the casting hole. To avoid this phenomenon it is necessary in the known devices to allow a considerable steel quantity to flow in free jet form so as to heat the casting hole 2. The liquid metal cast during this period is in contact with the air and pollutes the metal contained in the distributor, which leads to a downgrading of a significant part of the cast steel. The position of the access hole 36 in the immediate vicinity of the casting hole 2 avoids this by reducing the passage time between the two positions to approximately 1 to 2 seconds. This time is sufficiently short to prevent the solidification of the metal in the runner.

There is consequently no need to heat the runner for 1 to 2 minutes by the passage of the steel jet as was necessary in the prior art. Therefore the liquid metal contained in the distributor is not polluted and there is no need to downgrade it. The contact joint 35 between the mobile plate 3 and the plate 34 of the jet protection tube is advantageously provided so as to have no gap, so as to ensure a complete seal between the two plates on changing from one to the other.

FIG. 5 is a larger scale, more detailed view of the liquid steel flow control device shown in FIGS. 1 to 4. The frame 15 is fixed beneath a base plate 17 integral with the ladle 1. The frame 15 has guidance means, e.g. constituted by a slide or rails, which make it possible to receive both the cover plate 3 and the plate 4 of the plate/jet protection tube assembly. The cover plate 3 is housed in a support 27 including the pressurizing means (not shown in FIG. 5), which permit the tight application thereof to the fixed plate 30. In an identical manner, the plate 34 is mounted in a support 29, which has pressurizing means (not shown in FIG. 5), which apply the upper face of the plate 34 to the lower face of the fixed plate 30 forming a tight joint between these two plates. FIG. 5 also shows the cross-section of fingers 40 of a manipulator to be described in conjunction with FIGS. 6 to 8.

One of the fingers 40 (to the right in FIG. 5) has an orifice for receiving a spindle 42 integral with the support 29 of the plate/jet protection tube assembly. Thus, the spindle 42 makes it possible to fix the plate/jet protection tube assembly to the finger of the manipulator. The spindle 42 also makes it possible to withdraw the support 29 from the frame.

Figure 5A:
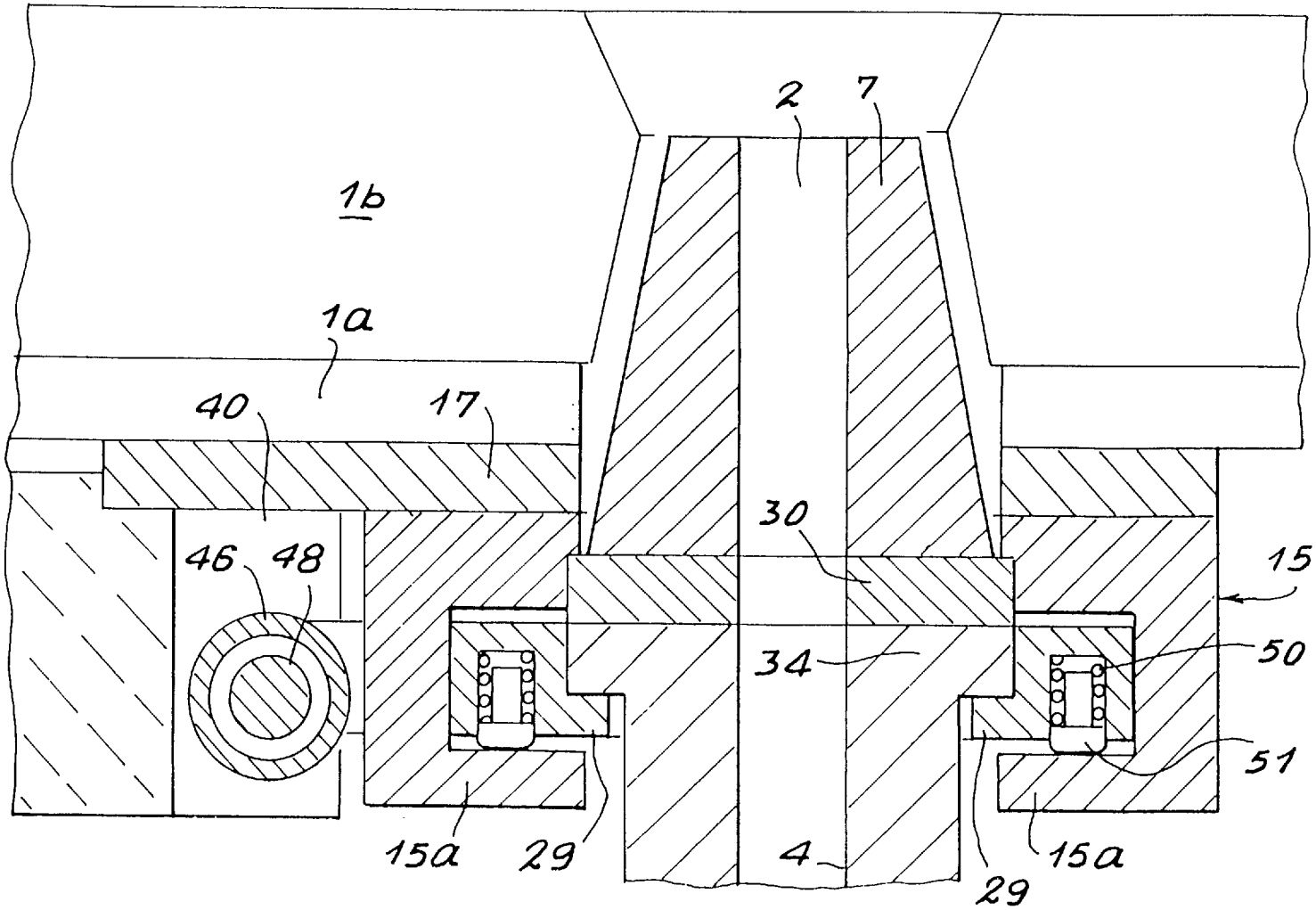
FIG. 5*a* A cross-sectional view of the device of FIG. 5.

FIG. 5*a* is a cross-sectional view of the device. The frame 15 has rails 15*a* on which slides the support 29 of the tube and the plate 34. The springs 30 push on shoes 51 which are applied to the rails 15*a*. The action of the springs 50 pushes the plate 34 upwards against the fixed plate 30. The entrance of the guide rails 15*a* is inclined in such a way that the springs 50 are slackened when the support 29 is presented at the entrance of the rails. The springs are progressively compressed as the plate/tube assembly is pushed towards the fixed plate 30. Thus, plate 34 is progressively pressurized. The pressure reached is sufficient to ensure sealing when the plate 34 or plate 3 arrive in a facing position with respect to the casting hole 2.

Figure 6:
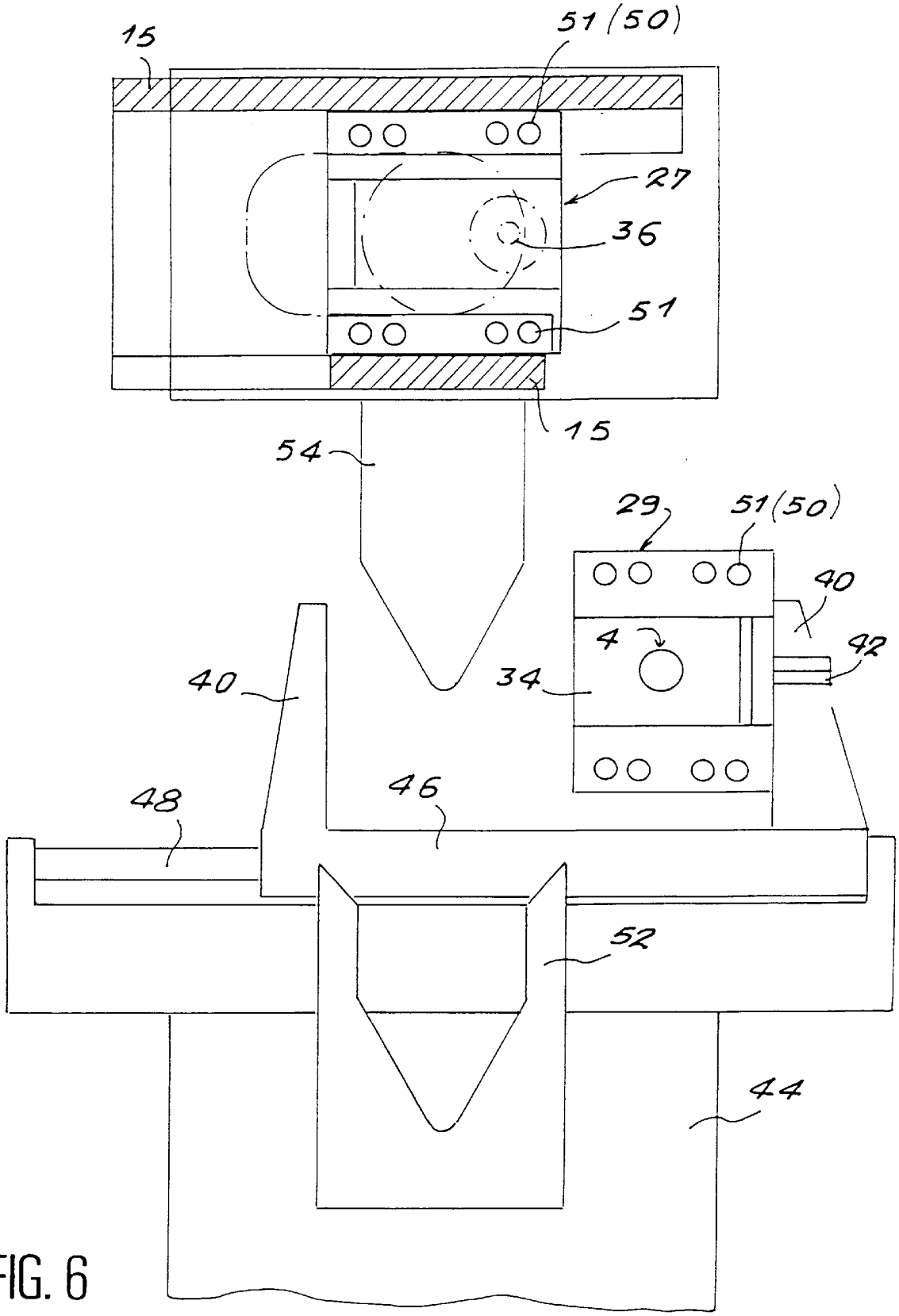
FIG. 6 A plan view of the device of FIG. 5, the manipulator being removed from the frame.

FIG. 6 is a plan view of the device according to the invention. The manipulator designated overall by the reference 44 has a jack body 46, which slides on the jack rod 48, whose two ends are fixed to the manipulator 44. The jack constitutes the second actuating means. The jack body 46 supports the two fingers 40 described hereinbefore. These fingers act like forks for pushing the plates 3 and 34 in one or other direction. The support 29 shown in plan view in FIG. 6 is articulated about the spindle 42, so that the tube can be presented in a horizontal position during its introduction between the ladle and the distributor, as described hereinbefore. The support 29 has springs 50, which constitute the pressurizing means of the plate 34.

In FIG. 6 the manipulator 44 is shown in a position spaced from the ladle 1. It can be moved towards said ladle by means of first, not shown actuating means, e.g. jacks. The guide 52 integral with the manipulator 44 cooperates with a counterguide 54 integral with the frame 15. These two guides make it possible to automatically adjust the position of the manipulator with respect to the ladle. When the manipulator advances the guide 52 is fitted in the counterguide 54, which ensures the centring of the manipulator.

Figure 7:
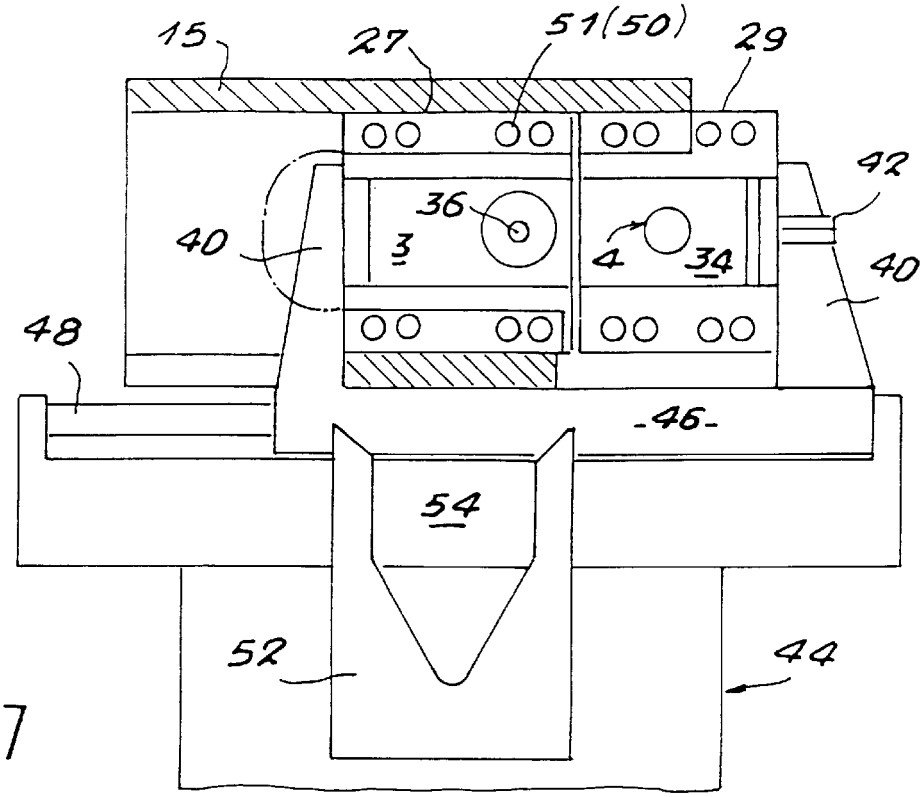
FIG. 7 A view identical to FIG. 6, the manipulator being joined to the frame.

FIG. 7 shows the manipulator 44 in a position joined to the frame 15. In this position the counterguide 54 is completely fitted within the guide 52 of the manipulator and the support 29 is placed alongside the support 27 of the cover plate 3. Like the support 29, the support 27 has springs 50 forming means for pressurizing the cover plate 3. The guide 52 and counterguide 54 make it possible to cancel out the reaction forces of the jack 46, so that no force is transmitted to the ladle 1.

Figure 8:
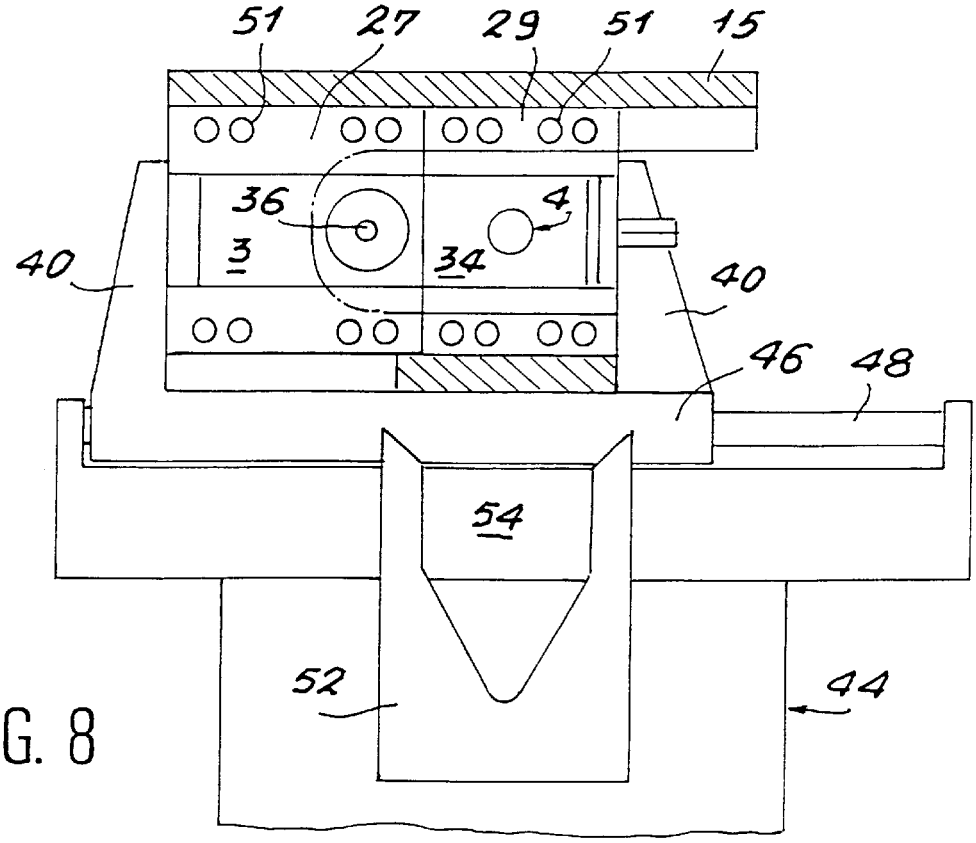
FIG. 8 A view identical to FIGS. 6 and 7, the cover plate and the plate/jet protection tube assembly having been displaced.

The jack is then actuated to push the support 29 against the support 27 and displace them simultaneously, which leads to the position shown in FIG. 8. In FIG. 8 the jet protection tube faces the casting hole 2, whilst the cover plate has been removed from this position. However, it continues to be held by the frame guide rails. As from this position it is possible easily to return to the position shown in FIG. 7, by actuating the jack 46 in the opposite direction. It is also possible to pass to the position shown in FIG. 4, where the access hole of the cover plate 3 faces the casting hole 2, so as to clean the latter by means of an oxygen lance.

The device described hereinbefore makes it possible to regulate the liquid steel flow by making the plate slide on guide means with the aid of the manipulator. However, with this solution, the constriction of the passage section is in the upper part of the jet protection tube, which leads, as stated hereinbefore, to a venturi phenomenon. This is why, according to a variant, the liquid steel flow regulation takes place at the lower end of the jet protection tube.

Figure 9:
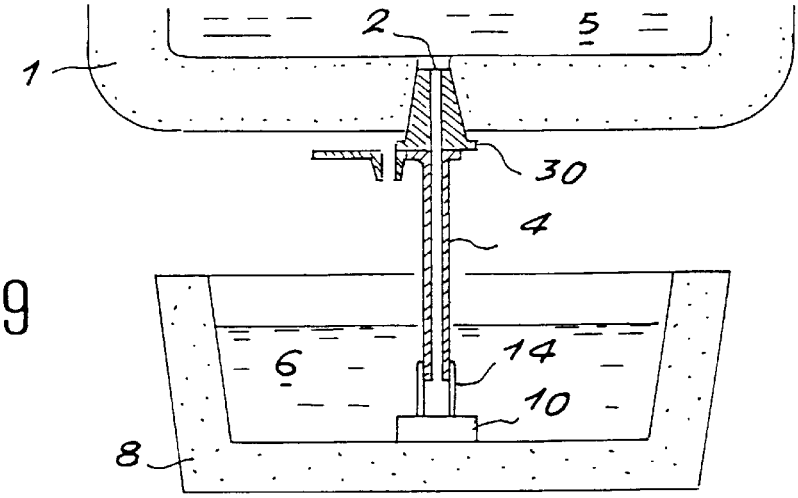
FIGS. 9, 10, 11, 12, 13 and 14 Variants of the steel outflow regulating means.

In FIGS. 1 and 9 a firebrick 10 is placed on the bottom of the distributor. The tube 4 has an orifice with a sufficient cross-section to permit the maximum flow rate required for the liquid metal.

To regulate the outflow of liquid metal from the ladle 1 to the distributor 8, it is merely necessary to vary the passage section offered to the fluid at the lower end of the casting tube 4. This can be achieved by numerous appropriate means. In particular, in the device shown in FIG. 1, it is possible to lower the ladle so as to move together the lower end of the tube 4 and the firebrick 10. The same result could be achieved by leaving the ladle stationary and moving the distributor towards it. It would also be possible to simultaneously vary the position of the two containers.

Apart from its very significant simplicity, this device has the major advantage of avoiding the known venturi phenomenon, which leads to the suction of air into the casting tube. Thus, as has been established, the small passage cross-section offered to the fluid is located between the lower end of the tube 4 and the firebrick 10. The jet protection tube is maintained under an overpressure with respect to the atmosphere throughout casting, no matter what the degree of throttling of the jet. A possible leak in the tube or at the junction between the tube and the ladle will consequently give rise to no suction of air, which guarantees the quality of the metal produced.

The fact that the security closing function is ensured by the cover plate 3 independently of the regulation function is advantageous, because it is permanently possible to leave a certain clearance between the lower end 4*a* of the casting tube 4 and the firebrick 10. Therefore there is a reduction in the risk of the tube 4 being destroyed by accidental contact with the firebrick 10.

The flow is adjusted by regulating the distance between the ladle and the distributor 8. It should be noted that at the start of casting the distance between the ladle and the distributor generally exceeds the limit value permitting regulation. Therefore there is a maximum flow rate for a certain time. However, this is not disadvantageous, because at this time it is necessary to fill the distributor as quickly as possible. The operator then has several minutes for reducing the distance between the ladle and the distributor until the throttling value is reached.

Although the distance between the ladle and the distributor cannot be regulated rapidly, i.e. with a brief reaction time, in view of the considerable mass or weight of each of the two containers, the regulation obtained by the process and device according to the invention is adequate, particularly when the distributor has a large free surface, so that the level of the liquid metal which it contains varies slowly.

In the constructional variant illustrated in FIG. 9, the tube 4 is equipped at its lower end with a ferrule or collar 14 tightly fitted to the lower end of the tube. In the accidental case where the distance between the ladle 1 and the distributor 8 is excessively reduced, the collar 4 would force slide onto the tube. This would prevent the fracture of the tube 4, which would otherwise occur if its lower end struck the firebrick 10. Therefore the collar 14 constitutes a safety member.

Figure 10:
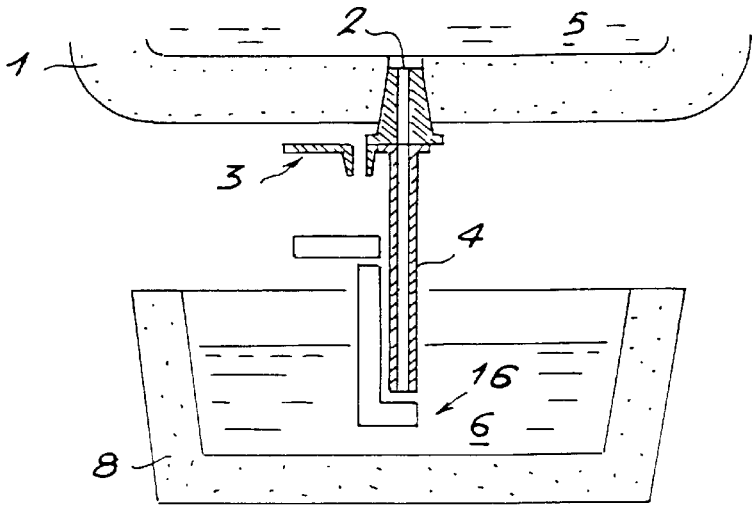

In the variant illustrated in FIG. 10, the varying obstruction of the lower orifice of the tube 4 is not brought about by adjusting the distance between the ladle 1 and the distributor 8. Instead it takes place by moving a firebrick 16 relative to the orifice of the casting tube 4 using independent, external means not shown in FIG. 10. This embodiment has the advantage of avoiding having to move heavy loads such as the ladle or distributor. It also provides an independent arrangement of containers rapidly replaceable during casting. It is always possible to replace the brick 16 whilst allowing a maximum flow to take place in the tube 4 or, if a maximum flow has not been authorized in temporary manner, to close the casting hole 2 using the complete independent closing device 3, as explained hereinbefore, during all or part of the replacement time for the firebrick 16.

Figure 11:
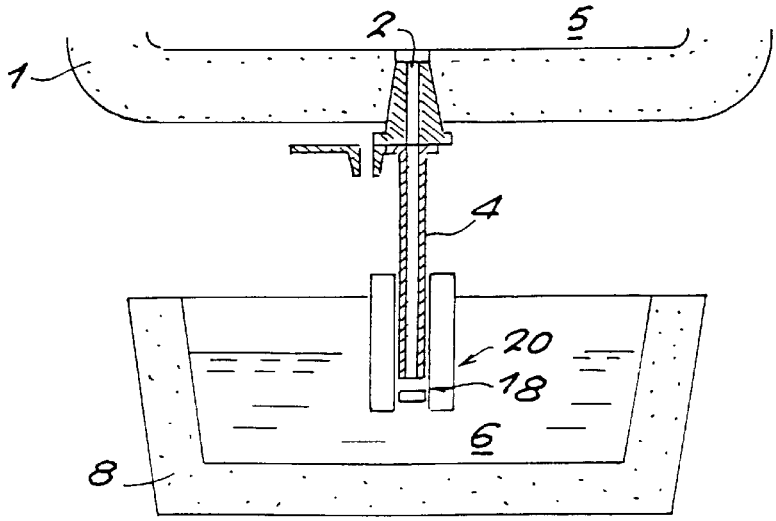

According to the variant illustrated in FIG. 11, at least one firebrick 20 is positioned facing the lateral orifice 18. The embodiment of FIG. 4 has two symmetrical orifices 18 and two firebricks 20. The brick or bricks 20 can be moved in or away from the orifices 18 in order to limit the passage cross-section offered to the fluid. The bricks 20 are actuated by an independent, external mechanism not shown in the drawing.

In the particular case where the tube 4 only has one orifice such as 18 or several orifices on the same side of the tube, the brick or bricks 20 can be kept fixed and the distance between the orifice or orifices 18 and the brick or bricks 20 can be regulated by a lateral movement of the ladle 1.

The embodiment of FIG. 11 in which the orifices are arranged symmetrically with respect to the longitudinal axis of the jet protection tube leads to a mutual compensation of the effect of the lateral reaction forces produced by the ejection of liquid metal. Thus, the jet protection tube is not subject to a high bending moment. The movement of the brick or bricks 20 relative to the orifice or orifices 18 can be rotary, linear or any other movement composition provided that it permits the reduction of the passage section offered to the fluid and consequently permits a control of the liquid metal flow rate.

Figure 12:
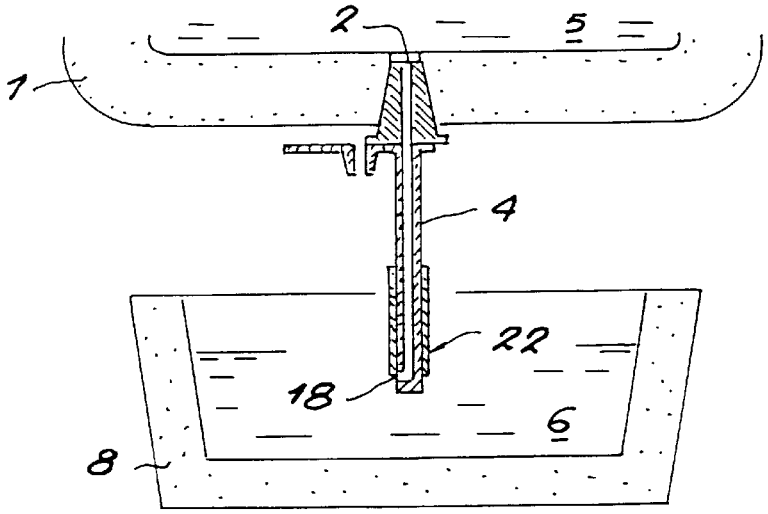

In the variant illustrated in FIG. 12, the tube 4 has at least one lateral outlet orifice 18. A sleeve 22, concentric to the tube 4 is placed around the latter and can slide longitudinally under the action of displacement means, which are not shown in the drawing. The sleeve 22 seals to a greater or lesser extent the outlet or outlets 18 of the tube 4. Identically to what has been described in conjunction with FIG. 4, it is preferable for the outlets 18 to be symmetrically distributed on the periphery of the tube 4, so as to compensate the reaction forces exerted at the lower end of the tube.

It should be noted that as the flow rate regulating sleeve 22 is not intended to entirely close the orifices 18, in view of the fact that the closure is ensured by separate means, there can be an operating clearance between the sleeve 22 and the tube 4. This clearance greatly facilitates construction and renders secure operation by eliminating risks of the sleeve locking on the tube.

In the variant shown in FIG. 3, the protective tube 4 has at its lower end one or more lateral orifices 18, as in the embodiments of FIGS. 4 and 5. A refractory sleeve 24 is fitted to the lower end of the jet protection tube 4. The sleeve 24 has one or more orifices 19. It rotates relative to the tube 4, so that its orifice or orifices 19 can be displaced relative to the orifice or orifices 18 of the jet protection tube 4. The passage cross-sections of these orifices consequently overlap to a greater or lesser extent, which ensures the sought regulation. An identical result can be obtained by a translation of the sleeve 24 along the tube 4.

For both this and the preceding embodiments it is possible to have a clearance between the sleeve 4 and the jet protection tube 4, which also facilitates the implementation of this variant.

Figure 13:
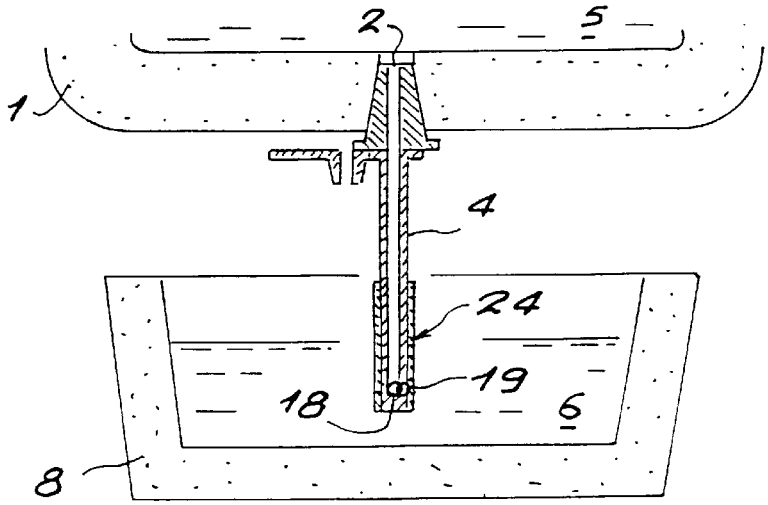
Figure 14:
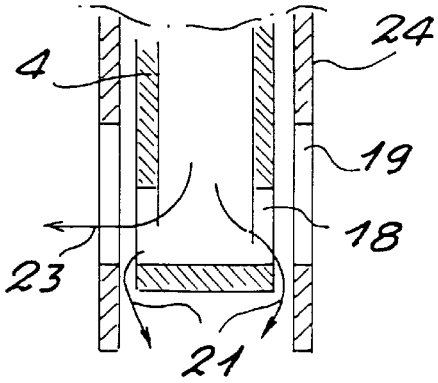

FIG. 13 shows a constructional detail of an advantageous variant of the sleeve 24. Thus, as has been shown hereinbefore, the collar is not accurately adjusted to the external diameter of the tube 4 and a clearance remains between the two parts. Consequently when the orifice 18 is sealed from the top (FIG. 13), the liquid metal tends to pass between the sleeve 24 and the external diameter of the tube 4 and gushes onto the surface of the liquid metal bath. To avoid this phenomenon, the orifice or orifices 18 are sealed from the bottom. To this end the sleeve 24 has orifices 19, e.g. in the same number as the orifices 18. Sealing takes place from the lower edge of the orifices following the collar upwards. Thus, most of the jet is directed upwards (arrows 23). This jet is weakened by the liquid metal bath. Another part of the outflow passes into the clearance between the tube 4 and the sleeve 24 (arrows 21), which offers no disadvantage because the outflow is directed towards the bottom of the distributor. Sealing can also take place by a rotary movement of the sleeve 24, the orifice or orifices thereof being slightly upwardly displaced with respect to the tube orifices 18.

I claim:

1. Installation for controlling the flow of liquid steel, incorporating a ladle, a continuous casting distributor able to contain a liquid steel bath and located on a continuous casting platform, said ladle being able to contain and transport a liquid steel quantity between a remote site and the continuous casting platform, the ladle being provided with a casting hole permitting the transfer of said steel quantity into the distributor, said casting hole being surrounded by a fixed, upper plate, a frame fitted beneath the ladle and having guidance means, a plate able to move on the guidance means and seal the casting hole, means for pressurizing said plate, means for protecting the liquid steel jet during its passage from the ladle to the distributor, said means incorporating a jet protection tube to be placed in an extension of the casting hole and which has a lower end to be immersed on the liquid steel bath contained in the distributor and means for bringing about a constriction of a passage section offered to the liquid steel, wherein:

the plate able to seal the casting hole is a cover plate intended solely to seal the casting hole, the jet protection tube is formed in a rigid plate/jet protection tube assembly with a plate, whereby said plate/jet protection tube assembly can be received and displaced on guidance means so as to face the casting hole on replacing the cover plate which is pushed out of this position, pressurizing means being provided for keeping the plate of the plate/jet protection tube assembly tightly applied against the fixed, upper plate, the means for bringing about a constriction of the passage section offered to the steel comprise the jet protection tube.

2. Installation according to claim 1, wherein the means for bringing about a constriction of the passage section offered to the liquid steel are located at the lower end of the jet protection tube for immersing in the liquid steel bath contained in the distributor.

3. Installation according to claim 1 further comprising a manipulator independent of the ladle and located in a position linked with the continuous casting platform, said manipulator having at least two actuating means, a first actuating means making it possible to move in and move away that plate/jet protection tube assembly with respect to the entrance of the guidance means, and a second actuating means permitting the introduction of the cover plate and the plate of the plate/jet protection tube assembly into the guidance means of the frame and push the plate of the plate/jet protection tube assembly in front of the casting hole, so that it pushes away the cover plate or vice versa.

4. Installation according to claim 3, wherein the second actuating means is constituted by a fork formed by two fingers, a first finger permitting the pushing of the plate/jet protection tube assembly and the cover plate, and a second finger exerting a reciprocal action to bring the cover plate and the plate/jet protection tube assembly in front of the fixed plate.

5. Installation according to claim 4, wherein the first finger is able to support the plate/jet protection tube assembly.

6. Installation according to claim 3, wherein the manipulator has a guide and the frame a counterguide in which the manipulator guide engages to adjust the position of the manipulator relative to the frame.

7. Installation according to claim 1, wherein the cover plate and the plate/jet protection tube assembly are placed in a support incorporating said pressurizing means.

8. Installation according to claim 1, wherein the means for constricting the passage cross-section offered to the liquid steel comprise a firebrick integral with the distributor, positioned facing the orifice of the jet protection tube the device incorporating means for varying a relative position of said ladle and said distributor or means for varying a relative position of said distributor and said ladle.

9. Installation according to claim 1, wherein the jet protection tube is extended by a sleeve coaxial to the tube and sliding under hard friction on said tube, so as to ensure security if the distance between the continuous casting ladle and the distributor was accidentally reduced.

10. Installation according to claim 2, wherein the means for constricting the passage section offered to the liquid steel are constituted by at least one mobile firebrick facing at least one outlet orifice for the liquid steel provided in the lower part of the jet protection tube.

11. Installation according to claim 2, wherein several orifices are provided on a lower part of the jet protection tube, said orifices being mutually regularly spaced, and in that the means for constricting the passage section offered to the liquid steel are symmetrically actuated so as not to create a lateral reaction force on the end of the tube.

12. Installation according to claim 2, wherein the jet protection tube has at least one lateral orifice in a lower part and in that regulation of the liquid steel outflow is obtained by a sleeve coaxial to the jet protection tube mobile in translation along the jet protection tube or mobile in rotation about said tube.

13. Installation according to claim 12, wherein the sleeve has at least one orifice for regulating the liquid steel outflow, a lower edge of said orifice being positioned higher than a lower edge of the sleeve, and where the cross-section offered to the liquid steel is controlled by sliding said cover plate on said fixed plate.

14. Installation according to claim 1, wherein the cover plate has a solid area called the covering area and an access orifice outside the covering area, so as to give access to the casting hole of the continuous casting ladle without having to move aside the jet protection tube.

15. Installation according to claim 14, wherein the access orifice of the cover plate is positioned between the plate of the plate/jet protection tube assembly and the covering zone of the cover plate when said cover plate and said plate are engaged in the guidance means, said position of the access orifice being intended to reduce the distance necessary for passing from the position in which the access orifice faces the casting hole to the position in which the jet protection tube faces the casting hole.

16. A process for the control of the flow of liquid steel between a ladle and a continuous casting distributor able to contain a liquid steel bath, said ladle being able to contain and transport a liquid steel quantity between a remote site and a continuous casting platform, said ladle being provided with a casting hole permitting the transfer of said liquid steel quantity into the distributor, said casting hole being surrounded by a fixed, upper plate, a frame having guidance means being linked with the ladle, wherein:

a cover plate able to seal the casting hole is introduced into the guidance means of the frame, said cover plate is pushed in front of the fixed, upper plate, whilst applying it tightly against said fixed, upper plate, the casting ladle is filled with liquid steel, the ladle is brought onto the continuous casting platform, a plate/jet protection tube assembly, independent of the ladle, is introduced into the guidance means of the frame, this being performed on the continuous casting platform or in a vicinity thereof, the plate/jet protection assembly is pushed in front of the plate, which expels the cover plate, whilst tightly applying it to the fixed, upper plate, controlling the flow rate of said liquid steel by varying a passage cross-section ofered to said liquid steel flowing through plate/jet protection assembly.

17. The process according to claim 16, wherein a liquid steel outflow is regulated by sealing to a greater or lesser extent an orifice located at an end of the jet protection tube immersed in the liquid steel bath contained in the distributor.

18. The process according to claim 17, wherein the orifice located at the end of the jet protection tube is sealed to a greater or lesser extent by varying a relative position of said ladle and said distributor or by varying a relative position of said distributor and said ladle.

19. The process of claim 16, further comprising when the ladle is empty or in the case of an incident, the cover plate is again pushed in front of the fixed, upper plate and is tightly applied against said fixed, upper plate, which seals the casting hole and simultaneously frees the plate/jet protection tube assembly.

20. The process according to claim 16, wherein the plate/jet protection tube assembly is placed in the guidance means of the frame by means of a manipulator independent of the ladle and located in a position linked with the casting platform, and in that the cover plate or the plate/jet protection tube assembly is displaced by means of an actuating means linked with said manipulator.

21. The process according to claim 16, wherein the liquid steel outflow regulating function takes place independently of the closing function of the casting hole, said closing function of the casting hole being obtained by the cover plate (3) linked with the ladle.

22. Installation for controlling the flow of liquid steel, comprising a ladle, a continuous casting distributor able to contain a liquid steel bath and located on a continuous casting platform, said ladle being able to contain and transport a liquid steel quantity between a remote site and the continuous casting platform, the ladle being provided with a casting hole permitting the transfer of said steel quantity into the distributor, means for protecting the liquid steel jet during its passage from the ladle to the distributor, said means incorporating a jet protection tube to be placed in an extension of the casting hole and which has a lower end to be immersed in the liquid steel bath contained in the distributor, means for bringing about a constriction of a passage cross-section offered to the liquid steel, wherein the means for constricting the passage cross-section is located in the lower part of the tube and is at least partly immersed in the liquid steel bath of the distributor.

* * * * *